United States Patent [19]

Heide

[11] 4,154,043

[45] May 15, 1979

[54] CONTAINER LOADING SYSTEM

[75] Inventor: Henry A. Heide, Addison, Ill.

[73] Assignee: Velten & Pulver, Inc., Chicago Ridge, Ill.

[21] Appl. No.: 876,731

[22] Filed: Feb. 10, 1978

[51] Int. Cl.[2] ..... B65B 57/02; B65B 57/10; B65B 35/24

[52] U.S. Cl. ..... 53/55; 53/67; 53/245; 53/251; 53/536

[58] Field of Search ..... 53/55, 67, 536, 245, 53/249, 250, 251

[56] References Cited

U.S. PATENT DOCUMENTS

| | | | |
|---|---|---|---|
| 3,123,956 | 3/1964 | Fisher | 53/55 X |
| 4,010,595 | 3/1977 | Boyd | 53/55 |

*Primary Examiner*—Travis S. McGehee
*Attorney, Agent, or Firm*—Vogel, Dithmar, Stotland, Stratman & Levy

[57] ABSTRACT

A loading system for loading articles into containers includes a container handling assembly and an article handling assemby, the paths of which intersect at a loading station. The container handling assembly carries a series of empty containers which it intermittently drives for moving the forwardmost one to the loading station while pushing a filled container from the loading station. The article handling assembly includes an input conveyor which moves the articles to a loading conveyor having alternating conveyor sections and window sections passing over the loading station. A platen carries a plurality of upwardly extending pins and is movable vertically between a receiving position with the pins disposed through complementary holes in the bottom of the container at the loading station and a depositing position wherein the pins are withdrawn from the openings in the container. Stop means accurately positions each container at the loading station and shifting means feeds articles from the conveyor section at the loading station and into and through the trailing window section to deposit them gently on the pins. A control system includes a plurality of solenoids, relays and sensing switches for synchronizing the operations of the container handling assembly and article handling assembly.

23 Claims, 15 Drawing Figures

CONTAINER LOADING SYSTEM

BACKGROUND OF THE INVENTION AND PRIOR ART STATEMENT

The present invention relates generally to improvements in loaders for loading packages into containers, and specifically for loading into containers pliable packages of a plurality of fragile items to be maintained in a predetermined relation with respect to each other.

The present invention is an improvement of the apparatus disclosed in U.S. Pat. No. 4,030,620, issued to Maynard R. Euverard et al. on June 21, 1977 and assigned to the assignee of the present invention, the disclosure of which prior patent is incorporated herein by reference. While the Euverard et al. patent discloses an effective means for loading packages of fragile items into a container, it discloses no structure for handling the containers and for automatically moving empty containers to the loading station and for removing filled containers from the loading station.

The Edwards et al. U.S. Pat. No. 2,830,416, issued Apr. 15, 1958, and the Bauer U.S. Pat. No. 3,653,178, issued Apr. 4, 1972, both disclose bottle casing machines which utilize a plurality of retractable pins somewhat like those disclosed in the Euverard et al. patent, for lowering an array of bottles into a container. Each of the Edwards et al. and Bauer patents also discloses means for moving cases or containers to and from the loading station. However, both of these patents disclose a zigzag or dogleg path for the containers and, therefore, require a plurality of motive means for moving the containers along the various sections of the container path.

For example, in Edwards the containers slide down a chute in a first direction to a position adjacent to the loading station, then are pushed by a pusher in a second direction perpendicular to the first direction into the loading station and, after being filled, are pushed by a second pusher from the loading station in a direction parallel to the first direction. Similarly, in Bauer the containers are pushed horizontally to the loading station then, after being filled, are lowered to a discharge station at which point they are pushed by a pushing mechanism from the discharge station in a horizontal direction opposite to the direction in which they moved to the loading station.

Copies of these prior patents are filed herewith.

SUMMARY OF THE INVENTION

The present invention provides a loader for loading packages of a plurality of fragile items into containers and for automatically and simply moving the containers to and from a loading station.

It is a general object of the present invention to achieve an automatic handling of the empty and loaded containers in a simplified manner with a minimum of driving means.

It is another object of this invention to move the containers in a single direction to, through and from the loading station.

Another object of this invention is the provision of a loader of the type set forth, which includes apparatus for synchronizing the operation of the article handling assembly and the container handling assembly.

Another object of this invention is the provision of a loader of the type set forth which is selectively operable for loading either one or two layers of articles into each container.

Still another object of this invention is the provision of a loader of the type set forth which includes means for accumulating subsets of articles into a single set for loading into a container.

In summary, these objects are achieved by providing in a loader for loading into containers at a loading station sets of grouped individual articles, container handling apparatus comprising container transfer means for moving an empty container along a container path to the loading station while simultaneously removing a filled container from the loading station along the path and thereafter supporting the empty container at the loading station, stop means movable between a stop position in the path of a container accurately to position it at the loading station and a release position out of the path of the container to accommodate removal thereof from the loading station, conveying means for transporting a set of grouped individual articles along an article path to the loading station and into a container thereat, and control means coupled to the container transfer means and to the stop means and responsive to operation of the container transfer means in moving a container to the loading station for moving the stop means to the stop position thereof and for subsequently stopping the container transfer means, the control means being responsive to completion of the loading of a container for moving the stop means to the release position thereof and restarting the container transfer means to move a new empty container to the loading station and to remove the filled container from the loading station.

Further features of the invention pertain to the particular arrangement of the parts of the loader whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
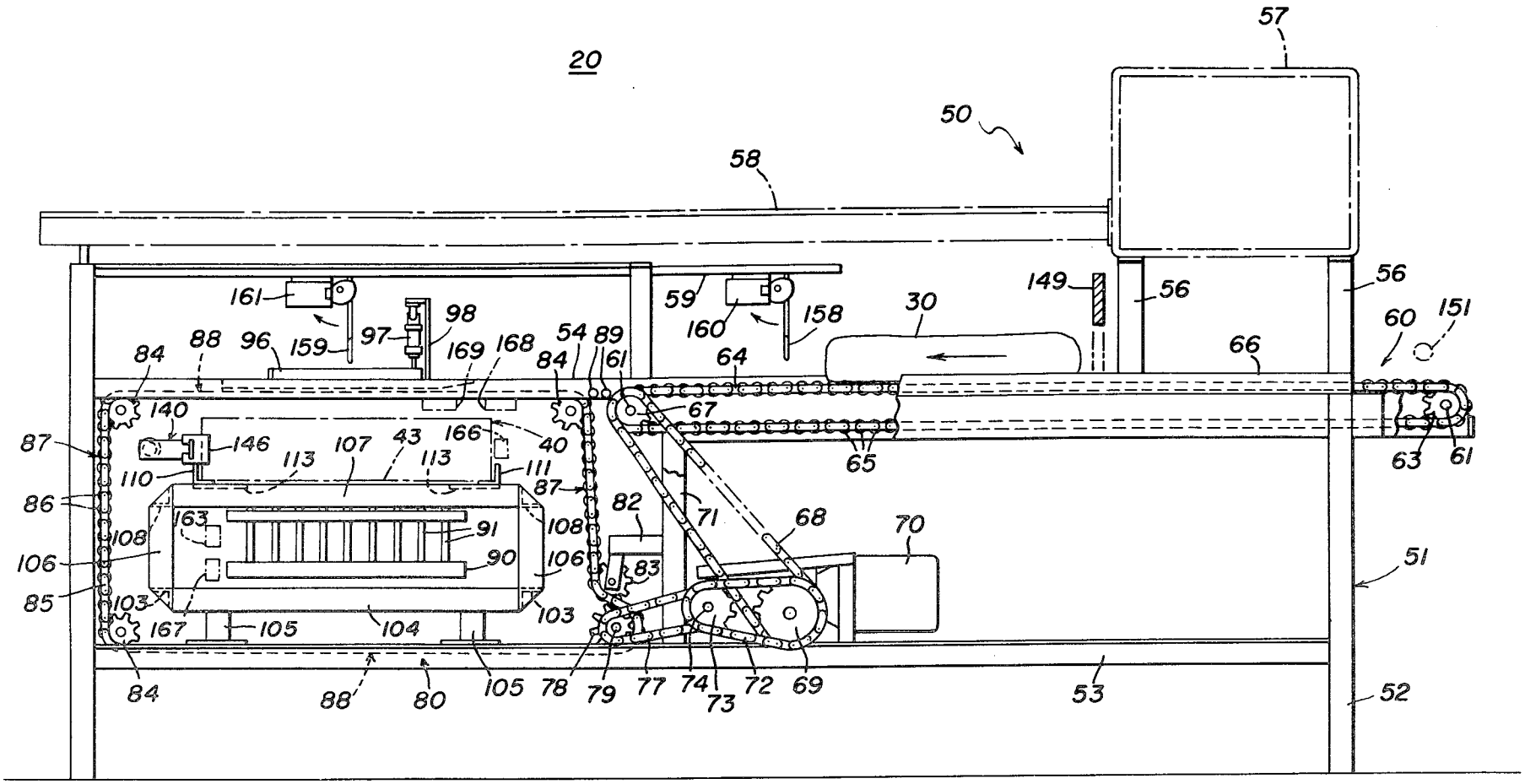
FIG. 1 is a side elevational view in partial section of the loading system of the present invention, with portions broken away more clearly to show the internal construction.
Figure 2:
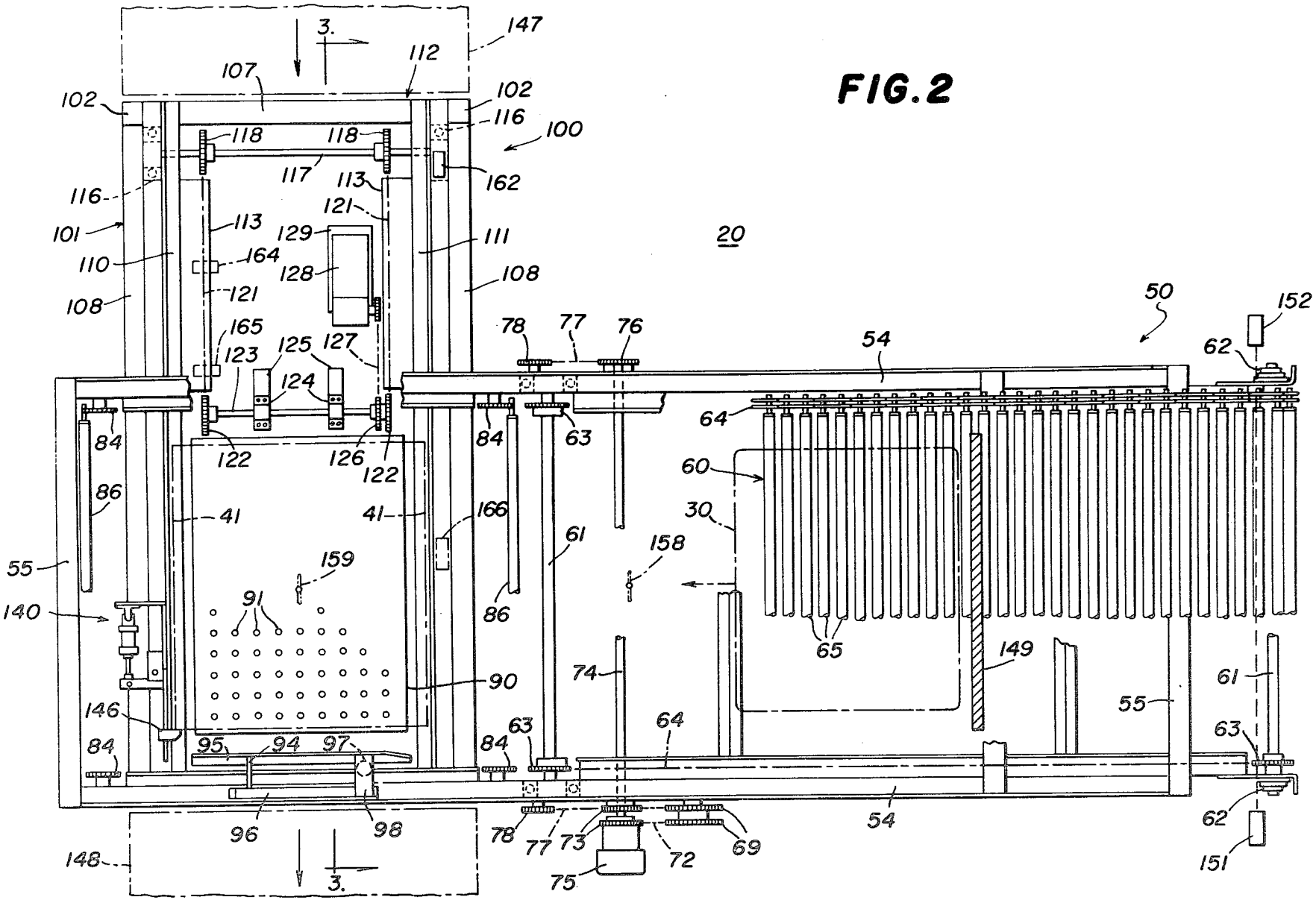
FIG. 2 is a top plan view of the loading system of FIG. 1, with portions thereof broken away.

Referring now to FIGS 1 and 2 of the drawings, there is shown a container loading system, generally designated by the numeral 20, for loading packages 30 of articles into containers 40, the system 20 including a package handling assembly 50 and a container handling assembly 100. The packages 30, the containers 40 and the package handling assembly 50 may all be as disclosed in the aforementioned U.S. Pat. No. 4,030,620. More particularly, each package 30 may be a package of sliced hamburger buns or the like, enclosed in a wrapping of a plastic, such as polyethylene or polypropylene plastic, it being necessary to maintain the upper and lower halves of the sliced buns in registry throughout the loading operation. The containers 40 may be in the form of plastic baskets, each being generally rectangular in shape and including a pair of opposed side walls 41 and a pair of opposed end walls 42 all closed by a flat rectangular bottom wall 43 having a plurality of holes or apertures therethrough, with the end walls 42 preferably extending downwardly a predetermined distance below the bottom wall 43 to define front and rear legs 44 (see FIG. 4) to facilitate handling and stacking of the containers 40. The package handing assembly 50 is arranged to load either one or two layers of the packages 30 in each of the containers 40, depending upon the thickness of the articles in each package 30.

It will be understood that the present invention is also useful for loading a set of individual items, such as individual portion pies, for example, into a basket, the items being grouped, and it being desirable to maintain the items in the group in their respective relationship with respect to each other and with respect to the group. Hereinafter, the phrase "set of grouped individual articles" is to cover both products such as the package 30, as well as sets of individual articles which may not be surrounded by a plastic cover. Furthermore, although the invention will be described in detail as applied to handling a package 30 containing hamburger buns in a so-called "pillow-pack", it is to be understood that the principles of the loading system 20 are also applicable to many other types of items that are to be loaded into a wide variety of shipping containers. Accordingly, it is to be understood that the following description is illustrative and is in no way to be considered a limitation of the use or application of the loading system 20.

The package handling assembly 50 includes a frame, generally designated by the numeral 51, comprising a plurality of upstanding posts 52 arranged in a generally rectangular pattern, and being interconnected by lower side beams 53, upper side beams 54 and end beams 55 to form a rigid framework. Extending upwardly from the upper side beams 54 adjacent to one end thereof are four vertically upstanding short posts 56 arranged in a rectangular configuration for supporting thereon, by means of suitable crossbeams, a control box 57 for housing the electrical control circuitry for the present invention. Communicating with the interior of the control box 57 at one end thereof and extending therefrom to the other end of the frame 51 substantially midway between the upper side beams 53 a predetermined distance thereabove and parallel thereto is a hollow conduit rail 58. Supported by suitable means just beneath the conduit rail 58 substantially parallel thereto is a center support rail 59 for a purpose to be explained more fully below.

Carried on the frame 51 is an infeed conveyor, generally designated by the numeral 60, which includes a pair of longitudinally spaced-apart and laterally extending parallel shafts 61, each provided at the opposite ends thereof with suitable bearings 62 for mounting thereon sprockets 63, with each pair of sprockets 63 at corresponding ends of the shafts 61 being engaged with the corresponding one of a pair of laterally spaced-apart endless roller chains 64 which cooperate to support therebetween a plurality of free rollers 65. Suitable guide means (not shown) maintain the rollers in the upper flight of the infeed conveyor 60 in a parallel configuration for cooperation to define a substantially planar support surface. The frame 51 may be provided at the opposite sides thereof with side plates 66 to protect the infeed conveyor 60. The input end of the infeed conveyor 60 (disposed to the right, as viewed in FIGS. 1 and 2) extends a slight distance to the right of the frame 51 and is positioned to receive packages 30 from upstream processing apparatus, such as a packet (not shown).

The shaft 61 at the output end of the infeed conveyor 60 carries an outer sprocket 67 at one end thereof for meshing engagement with a drive chain 68, which is in turn disposed in meshing engagement with one sprocket of a double sprocket assembly 69 coupled to the output shaft of an electric drive motor 70 mounted on the frame 51. The other sprocket of the double sprocket assembly 69 is disposed in meshing engagement with a drive chain 72 which is in turn coupled to one sprocket of a double sprocket assembly 73 mounted at one end of a horizontal shaft 74 extending transversely of the frame 51. Also mounted on the shaft 74 is a pneumatic brake/-clutch 75 which includes solenoid-actuated valves for operating the brake/clutch in a brake condition for stopping the shaft 74 or a clutch condition for accommodating rotation of the shaft 74. Mounted on the shaft 74 at the other end thereof is a sprocket 76, the sprocket 76 and the other sprocket of the double sprocket assembly 73 being respectively connected by drive chains 77 to sprockets 78 which are respectively mounted on stub shafts 79 at opposite sides of the frame 51.

Figure 11:
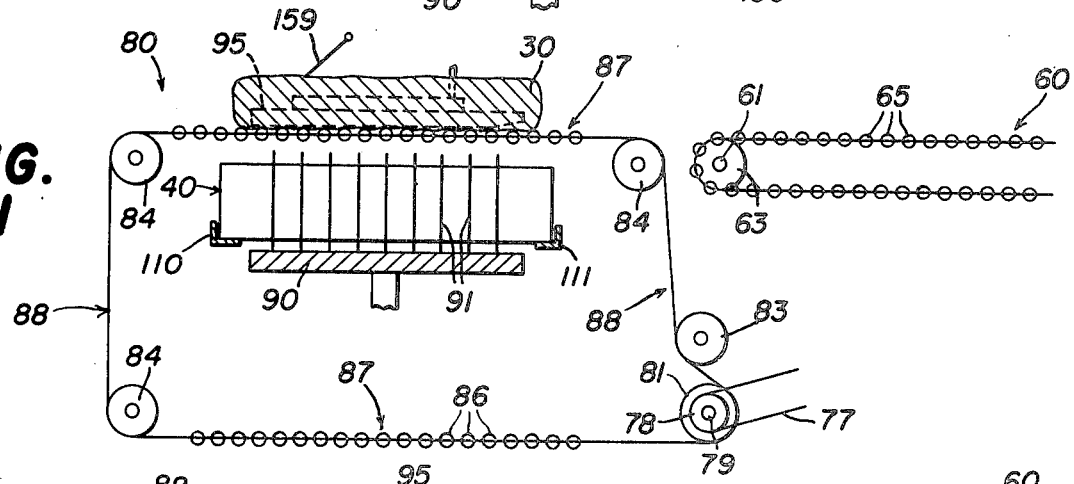
FIG. 11 is a fragmentary diagrammatic view similar to FIG. 1, illustrating the positions of the parts when a package of articles is about to be deposited on the platen pins.

Also mounted on each of the stub shafts 79 are inner sprockets 81 (see FIG. 11) which respectively engage laterally spaced-apart roller chains 85 of a loader conveyor, generally designated by the numeral 80. Each of the chains 85 also engages an idler roller 83 which is mounted on an associated stub arm 82 carried by a vertical upright member 71 of the frame 51. Each of the conveyor chains 85 also engages three sprockets 84 which are respectively mounted on corresponding stub shafts for cooperation to define generally rectangular parallel paths disposed in vertical planes for the conveyor chains 85, as illustrated in FIG. 1. The loader conveyor 80 includes two conveyor sections 87, each comprising a plurality of free rollers interconnecting the roller chains 85, the conveyor sections 87 being spaced apart by window sections 88 in which there are no rollers. The loader conveyor 80 is so mounted that when the conveyor sections 87 thereof are disposed along the upper flight of the loader conveyor 80, the rollers 86 cooperate to define a support surface substantially coplanar with that along the upper flight of the infeed conveyor 60. Preferably, idler rollers 89 are disposed between the output end of the infeed conveyor 60 and the adjacent entry end of the loader conveyor 80 to bridge the gap therebetween. Further details of the construction of the infeed conveyor 60 and the loader conveyor 80 are set forth in the aforementioned U.S. Pat. No. 4,030,620.

Situated between the conveyor chains 85 of the loader conveyor 80 and just beneath the upper flight thereof is a loading station. Disposed at the loading station is a generally rectangular horizontal platen 90 mounted by suitable pneumatically driven means (not shown) for vertical movement between a full down or depositing position (see FIGS. 1 and 3) and a full up or receiving position (see FIG. 10). The platen 90 carries thereon a plurality of upstanding pins 91 which are arranged in a regular pattern substantially covering the surface of the platen 90 and being adapted and arranged respectively to extend through the openings in the bottom wall 43 of an associated container 40 when it is disposed at the loading station, as will be explained more fully below.

As will also be explained more fully below, it is necessary to cause the free rollers 86 of the loader conveyor 80 to rotate in a counterclockwise direction, as viewed in FIG. 1, when they are at the loading station, and to this end there has been provided a shoe 95 which is mounted adjacent to one end of the rollers 86, and essentially overlying all rollers disposed along the upper reach of the loader conveyor 80 except for those immediately adjacent to the sprockets 84. The shoe 95 is secured by a pair of mounting arms 94 (one shown) to a pivot shaft 96 mounted for rotation about an axis parallel to the shoe 95, one of the arms 94 being coupled to the piston of an air motor 97 which is mounted on a bracket 98 for effecting pivotal movement of the shoe 95 between a retracted position out of engagement with the rollers 86 and a loading position pressed firmly against the free rollers 86 to effect a rotation thereof in a clockwise direction, as viewed in FIG. 1, for unloading a package from the loader conveyor 80 in the manner which is more fully described in the aforementioned U.S. Pat. No. 4,030,620.

Referring now also to FIGS. 3 through 6 of the drawings, the container handling assembly 100 includes a frame, generally designated by the numeral 101, comprising a pair of upstanding posts 102 spaced laterally from the frame 51 and cooperating therewith to support a pair of parallel lower beams 103 which extend substantially normal to the side beams 53 of the frame 51 a predetermined distance thereabove, the lower beams 103 being interconnected at the opposite ends thereof by crossbeams 104, one of which is supported on an adjacent one of the side beams 53 by stub posts 105. Extending upwardly from the opposite ends of each of the crossbeams 104 are upright members 106, the upper ends of which are interconnected by cross members 107 which extend parallel to the crossbeams 104 and by upper beams 108 which are parallel to the lower beams 103.

The upper cross members 107 are also interconnected by a pair of container track rails 110 and 111 which are respectively disposed a slight distance inwardly of the upper beams 108 and parallel thereto. Each of the container track rails 110 and 111 is preferably in the form of an angle member having one flange thereof upstanding, the other flanges extending horizontally inwardly toward each other and being substantially coplanar, whereby the container track rails 110 and 111 cooperate to define a track 112 dimensioned to support on the horizontal flanges thereof the opposite side edges of containers 40. The track 112 extends all the way through the loading station above the platen 90 and below the upper flight of the loader conveyor 80, the track 112 having an input end disposed to the left, as viewed in FIG. 3, and an output end disposed to the right, as viewed in FIG. 3, the length of the track 112 being such as to accommodate at least two of the containers 40 thereon in end-to-end relationship. For a purpose explained below, the vertical flange of the container track rail 110 terminates at an end edge 109 (see FIG. 7) spaced a predetermined distance short of the output end of the horizontal flange.

Two flat rectangular guide plates 113, each having a horizontal upper guide surface 114, are respectively fixedly secured to the horizontal flanges of the container track rails 110 and 111 intermediate the ends thereof and extend inwardly a predetermined distance beyond the inner edges thereof. Each of the guide plates 113 is substantially shorter than the corresponding container track rail 110 or 111 and terminates at an exit end edge 115 disposed adjacent to but outside the loading station.

Respectively carried beneath the upper beams 108 adjacent to the input ends thereof are laterally aligned pillow blocks 116 respectively rotatably supporting the opposite ends of a shaft 117 which extends tranversely of the track 102 and supports thereon a pair of spaced-apart sprockets 118 of a container drive conveyor, generally designated by the numeral 120. Respectively engaging the sprockets 118 are two endless roller chains 121 which also respectively engage sprockets 122 on a transverse shaft 123 supported in pillow blocks 124 on brackets 125, the shafts 117 and 123 being spaced apart a distance such that the guide plates 113 are disposed entirely therebetween, and with the shaft 123 preferably being disposed outside the loading station. The shaft 123 carries thereon a drive sprocket 126 which engages a drive chain 127 which is in turn coupled to a brake/-clutch **75*a* at the output of a drive motor 128 carried upon support arms 129 beneath the lower beams 103**.

Figure 4:
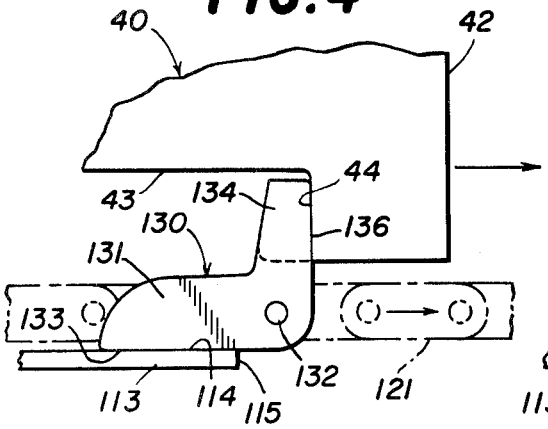
FIG. 4 is an enlarged fragmentary view of one of the drive lugs for the container drive conveyor shown in the driving position thereof.
Figure 5:
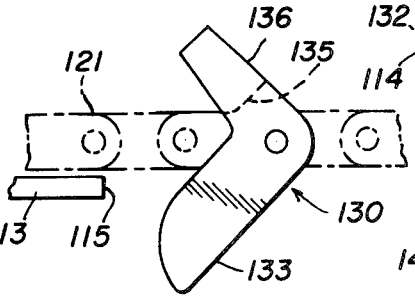
FIG. 5 is a view similar to FIG. 4, with the drive lug shown in the release position thereof.
Figure 6:
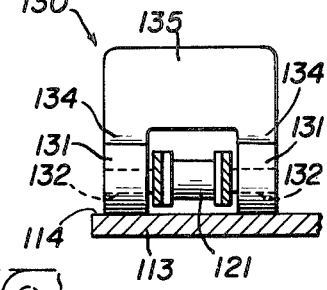
FIG. 6 is a fragmentary elevational view of the drive lug of FIG. 4, as viewed from the left-hand end thereof.

The roller chains 121 respectively carry thereon two laterally aligned drive lugs 130 which are identical in construction, whereby only one of the drive lugs 130 will be described in detail. Referring in particular to FIGS. 4 through 6, each of the drive lugs 130 includes a pair of attachment arms 131 which are respectively disposed on opposite sides of the associated roller chain 121 and are pivotally connected thereto by pivot pins 132 adjacent to the forward ends of the attachment arms 131. Each of the attachment arms 131 has a lower guide surface 133 and is integral at the pivot end thereof with a short arm extending therefrom substantially normal thereto, the short arms 134 being interconnected by a bight member 135 along the outer periphery of the roller chain 121, the forward surfaces of the arms 134 and bight member 135 being coplanar to define a drive surface 136. The drive lug 130 is pivotally movable between a drive position, illustrated in FIGS. 4 and 6, wherein the guide surface 133 is disposed for parallel sliding engagement with the upper guide surface 114 of the associated guide plate 113, and a release position, illustrated in FIG. 5, wherein the attachment arms extend inwardly of the loop of the roller chain 121 and the bight member 135 lies against the roller chain 121.

Figure 8:
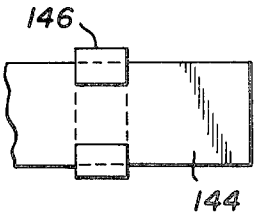
FIG. 8 is a fragmentary view taken along the line 8—8 in FIG. 7.
Figure 7:
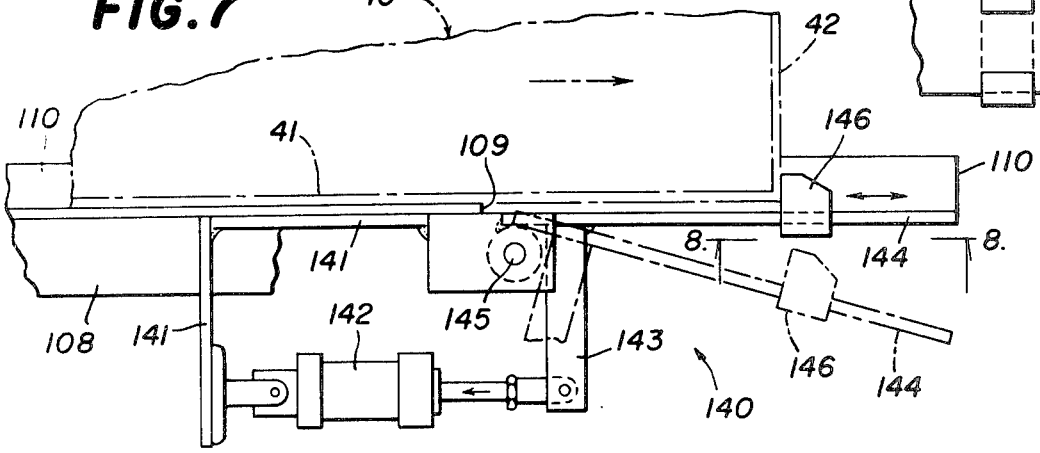
FIG. 7 is an enlarged fragmentary top plan view of the container stop mechanism of the loading system of the present invention, illustrating the two positions thereof.

Referring also to FIGS. 7 and 8 of the drawings, the container handling assembly 100 includes a container stop assembly, generally designated by the numeral 140, which includes a bracket 141 supported on one of the upper beams 108 and having pivotally mounted thereto one end of an air motor 142, the piston rod of which is pivotally mounted adjacent to one end of a clevis bracket 143, the other end of which is fixedly secured to an elongated flat rectangular stop bar 144 intermediate the ends thereof, one end of the stop bar 144 being secured to a pivto shaft 145 carried by the bracket 141, and the distal end of the stop bar 144 extending toward the output end of the track 112. Slidably mounted on the stop bar 144 is an adjustable stop lug 146 which projects inwardly from the stop bar 144 substantially normal thereto and may be fixedly secured thereto by suitable fastening means (not shown).

The stop bar 144 is pivotally movable by means of the air motor 142 between a stop position, illustrated in solid line in FIGS. 2 and 7, and a release position illustrated in broken line in FIG. 7. It will be appreciated that, in the stop position thereof, the stop bar 144 extends substantially parallel to the adjacent container track rail 110, with the stop lug 146 being positioned just beyond the end edge 109 of the vertical flange of the container track rail 110 and dimensioned to project laterally into the path of the container 40 therealong for engagement with the leading end of a container 40 to stop its movement along the track 112 in a loading position overlying the platen 90, with the openings in the bottom of the container 40 being respectively aligned with the pins 91. In the release position of the container stop assembly 140, the stop lug 146 is disposed out of the path of the container 40 to permit removal thereof from the loading station along the track 112. The sliding adjustability of the stop lug 146 along the stop bar 144 permits accurate positioning of the container 40 at the loading station.

Figure 3:
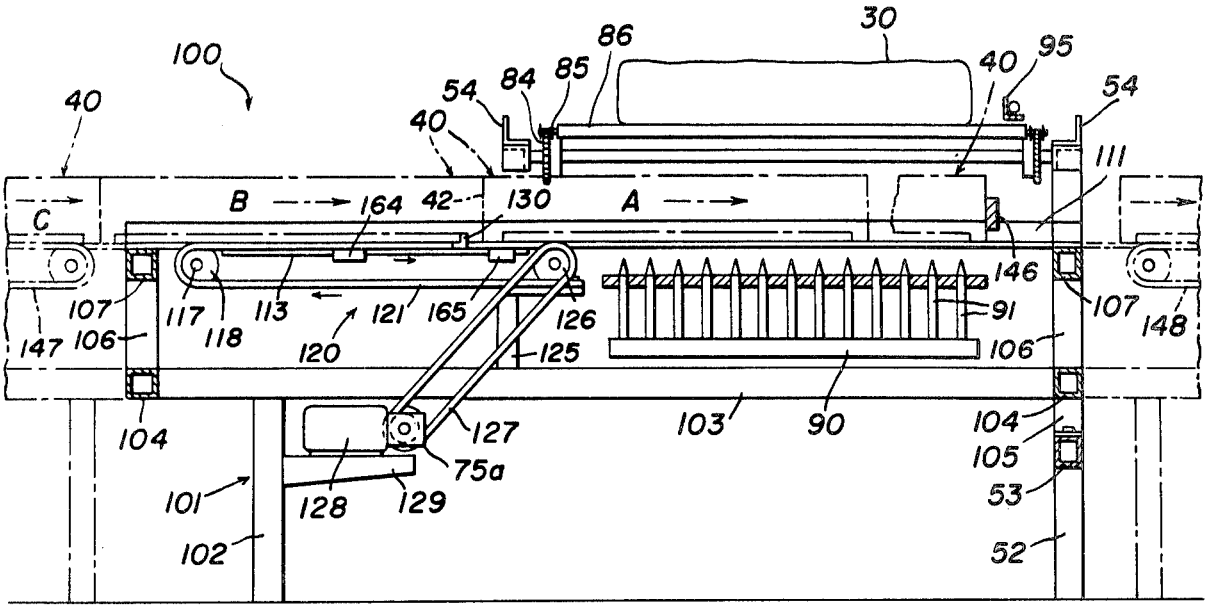
FIG. 3 is a view in vertical section taken along the line 3—3 in FIG. 2.
Figure 9:
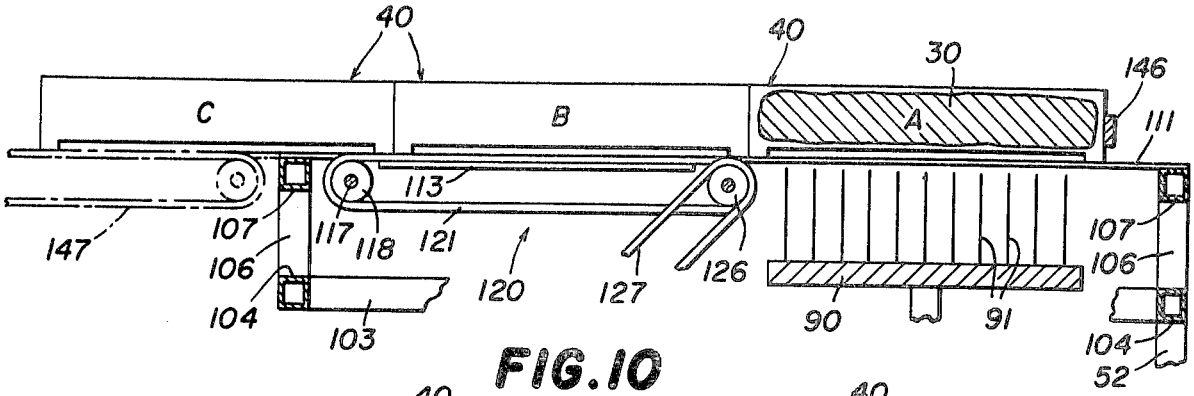
FIG. 9 is a diagrammatic view, similar to FIG. 3, illustrating the positions of the parts just prior to movement of a filled container from the loading station.
Figure 10:
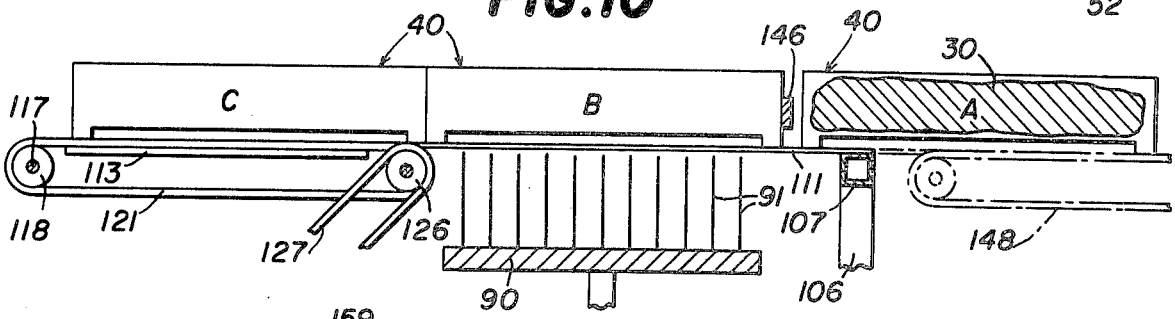
FIG. 10 is a diagrammatic view similar to FIG. 9, illustrating the positions of the parts when the filled container has been moved from the loading station and a new empty container has been moved thereinto.

In operation, there are normally a plurality of containers 40 arranged in end-to-end relationship along the track 112, the containers 40 being fed to the input end of the track 112 by an associated infeed conveyor 147 and being removed from the output end of the track 112 by an associated outfeed conveyor 148 (see FIGS. 1 and 3). Referring also to FIGS. 9 and 10, in the preferred embodiment there are at all times at least portions of three different containers 40 on the track 112, although it will be appreciated that the length of the track 112 could be such that any other desired number of containers 40 could be accommodated thereon. But normally the containers 40 are arranged on the track 112 in a contiguous series or train, the dimensions of the track 112 being so related to the dimensions of the containers 40 that when the forwardmost container in the series is positioned at the loading station in engagement with the stop lug 146, only the front part of the rearmost container 40 will be disposed on the track 112, extending slightly forwardly of the sprockets 118.

It will be appreciated that as the drive lugs 130 come around the sprockets 118, they will be in the release position illustrated in FIG. 5. As the drive lugs 130 move along the upper flight of the container drive conveyor 120, the guide surfaces 133 come into camming engagement with the leading ends of the guide plates 113 and are moved thereby to the drive position illustrated in FIG. 4, thereby bringing the drive surfaces 136 into driving engagement with the inner surface of the front leg 44 of the rearmost one of the containers 40 in the series of containers on the track 112 for driving engagement therewith. At this time, the container stop assembly 140 will be moved to the release position thereof in a manner to be described more fully below, and the continued movement of the container drive conveyor 120 drives the series of containers 40 along the track 112 to the right, as viewed in FIG. 3, thereby pushing the forwardmost container from the loading station and off of the track 112 to the outfeed conveyor 148, which is preferably moving at a greater linear speed than the container drive conveyor 120 to create a gap between the forwardmost container 40 and the next following container, which then becomes the lead container in the series on the track 112.

When this next container reaches the loading station, it will engage the stop lug 146, which will since have been moved back to the stop position thereof by means to be described below. The guide plates 113 are so positioned that at or immediately prior to the engagement of the lead container with the stop lug 146, the drive lugs 130 will pass the exit and edges 115 of the guide plates 113 and fall by gravity to the release positions thereof illustrated in FIG. 5. In this release position, the drive surfaces 136 will be disposed at an angle to the inner surface of the front leg 44 of the rearmost container 40 for camming engagement therebeneath as the drive lugs 130 continue around the sprockets 122. This camming movement may momentarily lift the leading end of the rearmost container 40 and will simultaneously move the lead container 40 snugly against the stop lug 146. A new empty container 40 will then be fed by the infeed conveyor 140 into engagement with the rear end of the series of containers 40 to be in position for engagement by the drive lugs 30 in the next cycle.

The container loading system 20 also includes a stop gate 149 which extends transversely of the infeed conveyor 60 intermediate the ends thereof (see FIGS. 1 and 2), the stop gate 149 being mounted by suitable means (not shown) for movement between a retracted position, illustrated in solid line in FIG. 1, out of the path of the packages 30 along the infeed conveyor 60, and a stop position, illustrated in broken line in FIG. 1, disposed in the path of the packages 30 along the infeed conveyor 60 for engagement therewith. The stop gate 149 is preferably pneumatically driven and is actuated by a photorelay 150 which includes a transmitter 151 and receiver 152 respectively disposed at opposite sides of the infeed conveyor 60 adjacent to the input end thereof for providing a light beam extending transversely of the infeed conveyor 60 and interruptible by packages 30 passing therealong, all for a purpose which will be explained more fully below.

Figure 14:
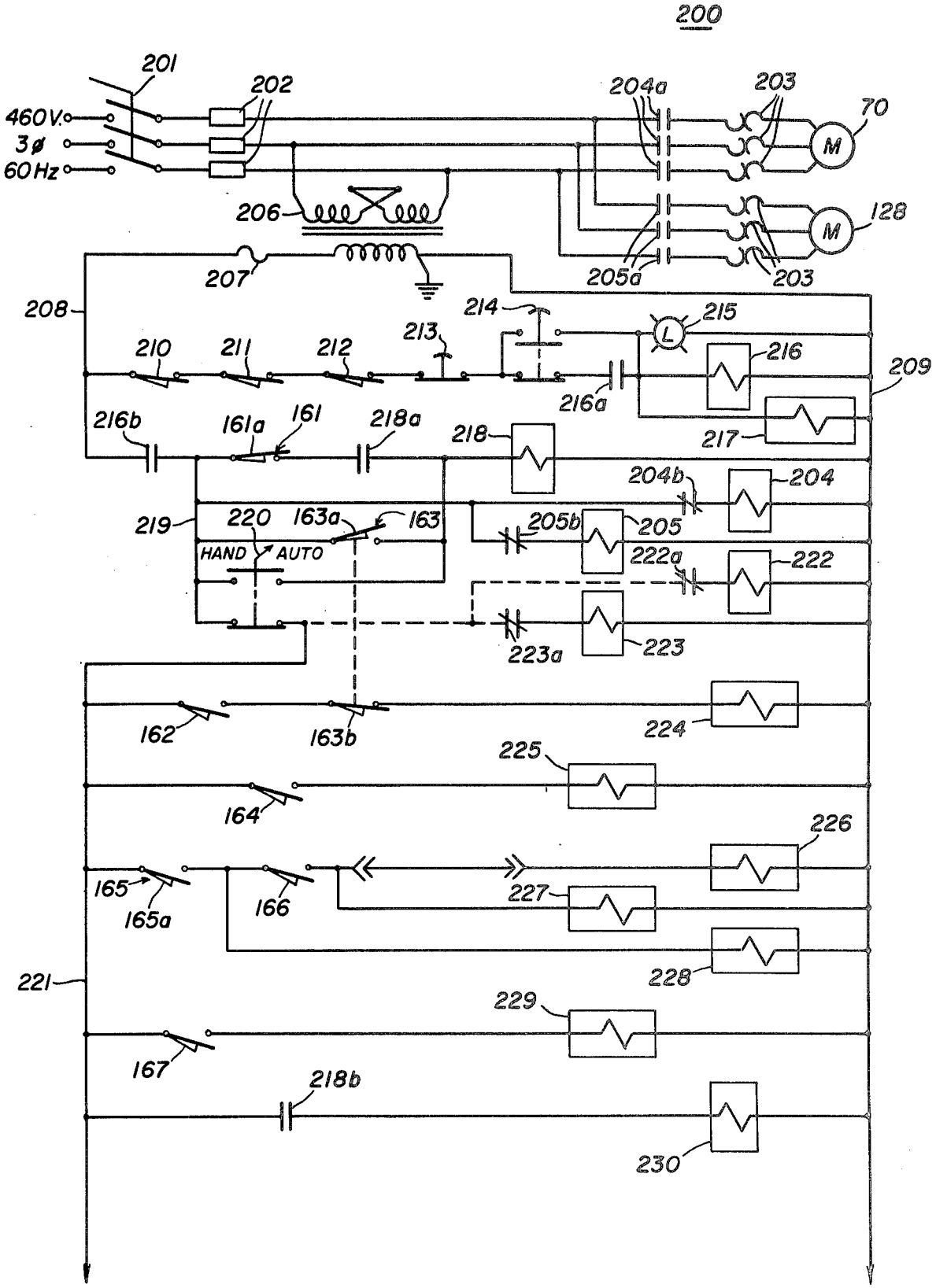
FIG. 14 is an electrical schematic circuit diagram of a portion of the control circuit for the present invention.
Figure 15:
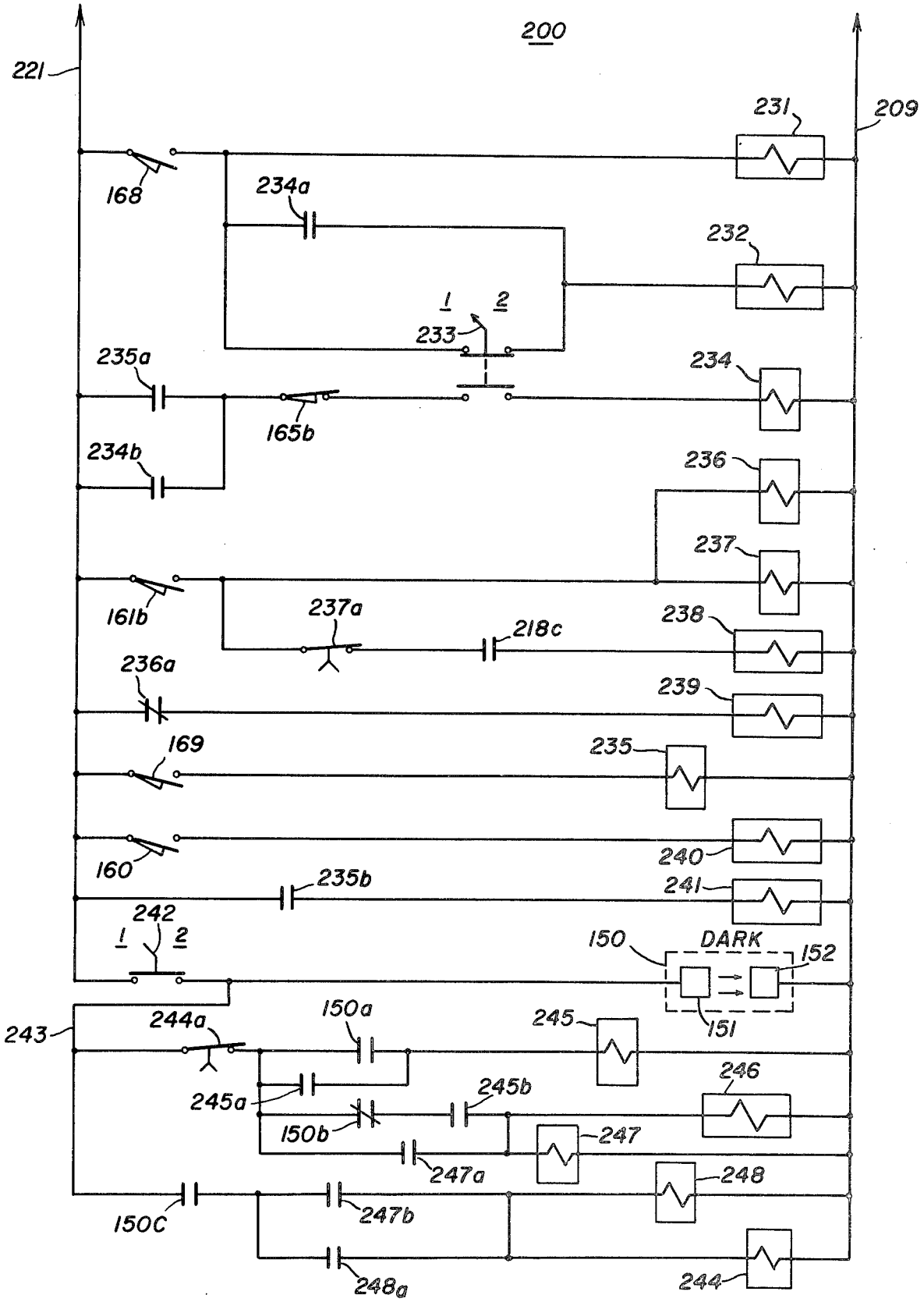
FIG. 15 is an electrical schematic circuit diagram of the remainder of the control circuit of the present invention.

In order to control the operation of the container loading system 20, there are provided a plurality of limit switches, all connected in a control circuit, generally designated by the numeral 200 (see FIGS. 14 and 15). More particularly, limit switches 160 and 161 (see FIGS. 1 and 2) are respectively supported by the center support rail 59, and are respectively provided with lever actuator arms 158 and 159, which respectively depend into the paths of the packages 30 along the infeed conveyor 60 and the loader conveyor 80 for engagement and actuation thereby, limit switch 161 being a double-pole switch. A limit switch 162 (see FIG. 2) is disposed adjacent to the input end of the track 112 for engagement by containers 40 passing therealong, while limit switches 164 and 165 (see FIGS. 2 and 3) are disposed along the container drive conveyor 120 for engagement by the drive lugs 130, limit switch 165 being a double-pole switch. A limit switch 166 (see FIGS. 1 and 3) is disposed adjacent to the container track rail 111 at the loading station for engagement by a container 40 in the loading station. Double-pole limit switch 163 and limit switch 167 (see FIG. 1) are disposed at the loading station for engagement by the platen 90, and limit switches 168 and 169 (see FIG. 1) are disposed at the loading station along the upper flight of the loader conveyor 80 for engagement by suitable lugs thereon (not shown).

Referring now to FIGS. 14 and 15 of the drawings, the electrical control circuit 200 for the container loading system 20 is shown. The system is powered from a 460-volt, 3-phase, 60 Hz source of electrical power, which is fed through a power switch 201, disconnect switches 202 and thermal overload switches 203 in parallel to the drive motors 70 and 128, the power being connected to the drive motor 70 through the normally-open contacts **204*a* of a relay 204, and to the drive motor 128 through the normally-open contacts 205*a* of a relay 205. Two of the three phases of the electrical power supply are connected to the primary of a transformer 206, the secondary coil of which has one terminal thereof connected through a fuse 207 to a conductor 208, and has the other terminal thereof grounded and connected to a conductor 209, the conductors 208 and 209** comprising control power input lines having a voltage therebetween of approximately 115 volts.

The conductor 208 is connected to the series combination of normally-closed safety switches 210, 211 and 212 and a normally-closed emergency stop switch 213. The safety switches 210–212 are limit switches which are coupled to various covers (not shown) which may be provided over certain parts of the container loading system 20 for protection of the apparatus as well as workmen operating it, the safety switches 210–212 being closed when the covers are closed and being opened when the covers are opened to de-energize the system. The emergency stop switch 213 is preferably a push-button type and is connected to the fixed contacts of both poles of a double-pole ON-OFF switch, preferably of the push-pull type. The other fixed contact of one pole of the ON-OFF switch 214 is connected through an indicator lamp 215 to the conductor 209, while the fixed contact of the other pole of the ON-OFF switch 214 is connected through the normally-open contacts **216*a* and coil of a relay 216 to the conductor 209, the lamp 215 being in parallel with the coil of the relay 216. Connected in parallel with the coil of the relay 216 is a solenoid 217, which controls a valve in the pneumatic system of the present invention for bleeding air therefrom when the container loading system is de-energized. It will be noted that the ON-OFF switch 214 is a three-position switch having a start position with both poles closed, a stop position with both poles open and a standby/run position, illustrated in FIG. 14, with the pole connected to the relay contacts 216*a*** closed and the other pole open.

The conductor 208 is also connected through the normally-open contacts **216*b* of the relay 216 to a conductor 219, and is also connected to the conductor 209 through the series combination of a normally-closed pole 161*a* of the limit switch 161, and the normally-open contacts 218*a* and coil of a relay 218. The conductor 219 is connected in parallel to the coils of the relays 204 and 205, respectively through their normally-closed overload contacts 204*b* and 205*b*, the coils 204 and 205 being in turn connected to the conductor 209. The conductor 219 is also connected through a normally-open pole 163*a* of the limit switch 163 to the junction between the contacts 218*a* and coil of the relay 218, this junction also being connected to the conductor 219 through one pole of a double-pole selector switch 220, the other pole of which is connected between the conductor 219 and a conductor 221. The selector switch 220 is arranged so that when one pole thereof is closed, the other is open, and is movable between a position illustrated in FIG. 14 for automatic operation of the container loading system 20, and another position for manual operation. If desired, the conductor 221 may be connected in parallel to relays 222 and 223, respectively through their normally-closed overload contacts 222*a* and 223*a*, these relay coils in turn being connected to the conductor 209 for respectively controlling the container infeed and outfeed conveyors 147 and 148**.

The conductor 221 is also connected to the conductor 209 through the series combination of the normally-open limit switch 162, a normally-closed pole **163*b* of the limit switch 163 and a solenoid 224. Also connected between the conductors 221 and 209 is the series combination of the normally-open limit switch 164 and a solenoid 225. The solenoids 224 and 225 control the valving on the brake/clutch 75*a* associated with the drive motor 128 of the container drive conveyor 120. The conductor 221 is also connected to the conductor 209 through the series combination of a normally-open pole 165*a* of the limit switch 165, the normally-open limit switch 166 and a solenoid 226. A solenoid 227 is connected in parallel with the solenoid 226, the solenoids 226 and 227 respectively being operative to elevate the platen 90** to upper and intermediate receiving positions thereof, in a manner to be described more fully below.

The junction between the limit switch pole **165*a* and the limit switch 166 is also connected to the conductor 209 through a solenoid 228. Also connected across the conductors 221 and 209 is the series combination of the normally-open limit switch 167 and a solenoid 229, the solenoids 228 and 229 controlling the valving for the air motor 142 of the container stop assembly 140 for respectively moving it to the stop and release positions thereof. The conductor 221 is also connected to the conductor 209 through the series combination of the normally-open contacts 218*b* of the relay 218 and the coil of a relay 230 which has delay contacts (not shown) in the control circuit of an associated packer upstream of the package infeed conveyor 60 for stopping the packer a predetermined time after the relay 218 is de-energized in the event of a prolonged stoppage of the container loading system 20**.

Also connected in series across the conductors 221 and 209 are the normally-open limit switch 168 and a solenoid 231. Connected in parallel with the solenoid 231 is the series combination of a solenoid 232 and one pole of a double-pole selector switch 233. Connected in parallel with that one pole are the normally-open contacts 234*a* of a relay 234, the coil of which is connected in series with the other pole of the selector switch 233, the normally-closed limit switch 165 and the normally-open contacts 235*a* of a relay 235 across the conductors 221 and 209. Connected in parallel with the relay contacts 235*a* are the normally-open contacts 234*b* of the relay 234.

Also connected in series across the conductors 221 and 209 are the normally-open limit switch 160 and the coil of a relay 237, which coil has connected in parallel therewith the coil of a relay 236. Also connected in parallel with the coil of the relay 237 is the series combination of normally-closed delay contacts 237*a* of the relay 237, normally-open contacts 218*c* of the relay 218 and a solenoid 238. Also connected in series across the conductors 221 and 209 are the normally-closed contacts 236*a* of the relay 236 and a solenoid 239.

The solenoids 231 and 232 respectively control the lowering of the platen 90 from its intermediate and upper receiving positions, while the solenoids 238 and 239 control the valving of the air motor 97, respectively to lower and raise the shoe 95.

Also connected in series across the conductors 221 and 209 are the normally-open limit switch 169 and the coil of the relay 235. The conductor 221 is also connected to the conductor 209 through the series combination of the normally-open limit switch 160 and a solenoid 240 and through the series combination of the normally-open contacts 235*b* of the relay 235 and a solenoid 241, the solenoids 240 and 241 being connected to the valving for the brake/clutch 75, respectively to start and stop the loader conveyor 80.

The conductor 221 is also connected through a single-pole selector switch 242 to a conductor 243 and to the transmitter 151 of the photorelay 150, the receiver 152 of which is connected to the conductor 209. Connected in series between the conductors 243 and 209 are the normally-closed delay contacts 244*a* of a relay 244, the normally-open contacts 150*a* of the photorelay 150 and the coil of a relay 245. Connected in parallel with the photorelay contacts 150*a* are the normally-open contacts 245*a* of the relay 245. The junction between the relay contacts 244*a* and 150*a* is connected to the conductor 209 through the series combination of the normally-closed contacts 150*b* of the photorelay 150, the normally-open contacts 245*b* of the relay 245 and a solenoid 246 which controls the raising and lowering of the stop gate 149. Connected in parallel with the solenoid 246 is the coil of a relay 247 which has normally-open contacts 247*a* connected in parallel with the relay contacts 150*b* and 245*b*. Also connected in series between the conductors 243 and 209 are the normally-open contacts 150*c* of the photorelay 150, the normally-open contacts 247*b* of the relay 247 and the coil of the relay 244. Connected in parallel with the coil of the relay 244 is the coil of a relay 248 which has normally-open contacts 248*a* connected in parallel with the relay contacts 247*b*.

The operation of the container loading system 20 will now be described in detail. In its normal mode of operation, the container loading system 20 is designed to load a single package 30 of articles or other set of grouped individual articles into each container 40. For this mode of operation, the control circuit 200 is initially in the configuration illustrated in FIGS. 14 and 15, with the selector switch 214 in its standby/run position, the selector switch 220 in the automatic position, the selector switch 233 in position for loading a single package into each container, and the selector switch 242 in the position indicated for the mode of operation wherein each set of grouped individual articles comprises a single package. Since the selector switch 242 is open in this position, it will be appreciated that the photorelay 150 and the circuitry controlling the stop gate 149 are all de-energized and inoperable. Referring to FIGS. 9 through 12 of the drawings, for purposes of discussion the system will be considered as being initially in the configuration illustrated in FIG. 9, with a series of three containers designated A, B and C on the track 112, with the forwardmost one thereof being disposed at the loading station and having a package 30 loaded thereinto, and with the platen 90 being disposed in its full down position.

Upon closure of the power switch 201, power is provided at the transformer 206 for producing a control voltage across the secondary winding thereof. When the ON-OFF switch 214 is moved to the ON position, closing the upper pole thereof, the lamp 215 is energized to indicate that power is being provided to the system 20, the solenoid 217 is energized to cut off the bleed from the pneumatic system, and the relay 216 is energized, thereby closing its contacts 216*a* to latch it in the energized position through the other pole of the ON-OFF switch 214 and closing its contacts 216*b* for energizing the relays 204 and 205, thereby closing the contacts 204*a* and 205*a* thereof to energize the drive motors 70 and 128 and start the infeed conveyor 60. The loader conveyor 80 does not start because the brake/clutch 75 is initially in the brake condition. If the relays 222 and 223 are connected in the circuit, they are also energized by the closure of the relay contacts 216*b* for respectively starting the container infeed and outfeed conveyors 147 and 148.

It will be noted that while the energization of the relay 205 energizes the drive motor 128, the brake/clutch 75*a* thereof will normally be in the brake condition, thereby preventing movement of the container drive conveyor 120 unless a new empty container is positioned at the input end of the track 112 for engagement by the drive lugs 130, as indicated in FIG. 9, in which case that rearmost container (designated C in FIG. 9) will close the limit switch 162 for energizing the solenoid 224 through the pole 163*b* of the limit switch 163 which is held closed by the platen 90 in its full down position. Energization of the solenoid 224 shifts the brake/clutch 75*a* on the drive motor 128 to the clutch condition for driving the container drive conveyor 120.

It will be noted that the container stop assembly 140 will be disposed in the release position thereof, having been placed in that position by energization of the solenoid 229 through the limit switch 167 which had previously been momentarily closed by the platen 90 during its descent to its full down position. As the drive lugs 130 move around the sprockets 118, they engage the front leg 44 of the rearmost one C of the containers 40 on the track 112 for driving the series A–C of containers to the right along the track 112 in the manner described above, and pushing the filled containers A from the loading station onto the outfeed conveyor 148. As the drive lugs 130 move along the upper flight of the container drive conveyor 120, they engage the limit switch 165 for closing the pole 165*a* thereof and thereby energizing the solenoid 228 for actuating the air motor 142 to move the container stop assembly 140 back to the stop position thereof with the stop lug 146 disposed in the path of the oncoming empty container B, this movement being accommodated by a gap between the containers A and B which is caused by the fact that the outfeed conveyor 148 is moving at a linear speed greater than that of the container drive conveyor 120.

At the time that the limit switch pole 165*a* is closed, the limit switch 166 will already have been closed by the arrival of the leading end of the container B at the loading station, so that when the limit switch 165 closes, the solenoids 226 and 227 will be energized for beginning the elevation of the platen 90 to its full up or upper receiving position. In this regard, it will be noted that the platen 90 is capable of disposition in a full down or depositing position and two receiving positions, viz., an upper receiving position and an intermediate receiving position, these positions being controlled by two separate pneumatic cylinders. When both of these cylinders are actuated, the platen 90 is moved between its full up and full down positions. As the platen 90 leaves its full down position the pole 163*b* of the limit switch 163 opens to de-energize the solenoid 224 and the pole 163*a* closes to energize the relay 218, thereby closing its contacts 218*a*, 218*b* and 218*c*, closure of the contacts 218*b* energizing the relay 230. If the relay 230 thereafter is de-energized for a predetermined time, the associated packer will be stopped. As the drive lugs 130 pass the limit switch 165 its pole 165*a* reopens, de-energizing the solenoids 226–228, but the conditions of the pneumatic drives for the platen 90 and container stop assembly 140 remain the same until positively changed by solenoids 231, 232 and 229, as explained below.

The movement of the platen 90 and the container drive conveyor 120 are synchronized so that the container B will have arrived at the loading station in engagement with the stop lug 146 by the time the pins 91 on the rising platen 90 enter the plane of the bottom wall 43 of the container 40, so that they may pass through the complementary apertures in the bottom wall 43. When the container B engages the stop lug 146, the drive lugs 130 close the limit switch 164 to energize the solenoid 225 and actuate the brake/clutch 75*a* on the drive motor 128 back to its brake condition to stop the container drive conveyor 120.

It will be appreciated that simultaneously with the operation of the container drive conveyor 120, the infeed conveyor 60 will be conveying a package 30 toward the loading station. When the package 30 engages the lever actuator 158 it closes the limit switch 160 to energize the solenoid 240 for actuating the brake/clutch 75 to the clutch condition thereof to start the loader conveyor 80. The operations of the infeed conveyor 60 and loader conveyor 80 are synchronized so that when the package 30 arrives at the output end of the infeed conveyor 60, the leading edge of one of the conveyor sections 87 will simultaneously be arriving in position at the upper flight of the loader conveyor 80 for receiving the package 30 thereon and carrying it to the loading station. By the time the package 30 has arrived at the loading station, the platen 90 has been raised to its full up position, illustrated in FIG. 11, with the pins 91 extending upwardly through a container 40, and as the package 30 arrives at the loading station, it engages the lever actuator 159 for closing the pole 161*b* and opening the pole 161*a* of the limit switch 161, the relay 218 being maintained energized through the now-closed pole 163*a* of the limit switch 163.

Closure of the pole 161*b* of the limit switch 161 energizes the relay 236 to open its contacts 236*a* for de-energizing the solenoid 239, and also energizes the solenoid 238 through the normally-closed relay contacts 237*a* and now-closed relay contacts 218*c* for actuating the air motor 97 to lower the shoe 95 into engagement with the rollers 86 of the loader conveyor 80 to cause rotation thereof in a clockwise direction, as viewed in FIG. 1, thereby feeding the package 30 from the conveyor section 87 and through the trailing window section 88 onto the pins 91, all as is described in greater detail in the aforementioned U.S. Pat. No. 4,030,620. Closure of the pole 161*b* of the limit switch 161 also energizes the solenoid 237 and, after a predetermined short delay, the contacts 237*a* thereof open to de-energize the solenoid 238, the shoe 95 remaining down until the condition of the air motor 97 is positively changed by the solenoid 239. When the package 30 has been completely fed through the window section 88 of the loader conveyor 80, it falls out of engagement with the lever actuator 159, thereby reopening the pole 161*b* and reclosing the pole 161*a* of the limit switch 161, for de-energizing the relay 236 and reclosing the contacts 236*a* thereof to re-energize the solenoid 239 and retract the shoe 95.

Figure 12:
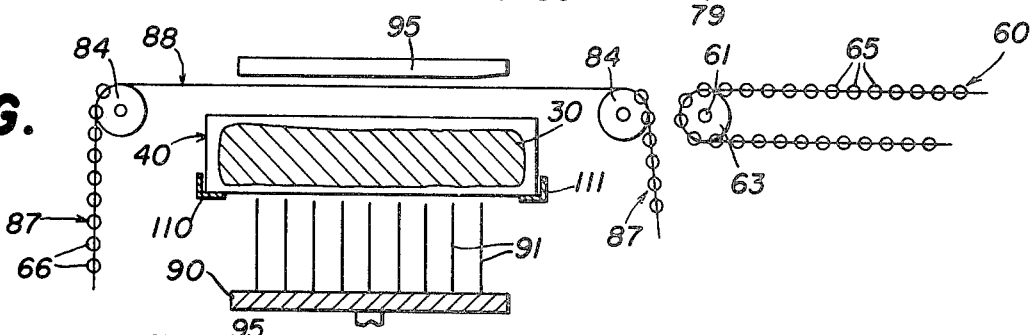
FIG. 12 is a diagrammatic view similar to FIG. 11, illustrating the positions of the parts after the package has been deposited in the container.

After the package 30 has been deposited on the pins 91, a lug on the loader conveyor 80 closes the limit switch 168 to energize the solenoids 231 and 232 for lowering the platen 90 to its full down position, illustrated in FIG. 12, and thereby depositing the package 30 in the container 40 at the loading station. As the lug on the loader conveyor 80 passes the limit switch 168, it reopens to de-energize the solenoids 231 and 232, the platen 90 continuing down until the condition of the pneumatic drive therefor is positively changed by solenoids 226 and 227. The lug on the loader conveyor 80 then closes the limit switch 169 to energize the relay 235, thereby closing the contacts 235*b* thereof to energize the solenoid 241 which operates to shift the condition of the brake/clutch 75 to its brake condition to stop the loader conveyor 80, the solenoid 240 having been de-energized when the package 30 passed the lever actuator 158 allowing the limit switch 160 to reopen.

As the platen 90 lowers to its full down position, it closes the limit switch 167 for energizing the solenoid 229 to move the container stop assembly 140 back to the release position thereof with the lug 146 out of the path of the container 40, this movement being permitted by reason of the previous de-energization of the solenoid 228 upon reopening of the pole 165*a* of the limit switch 165 as the drive lugs 130 passed thereby. When the pins 91 are fully withdrawn from the openings in the bottom of the container 40, the platen 90 actuates the limit switch 163 to reopen the pole 163*b* thereof. In the meantime, a new empty container 40 will have been deposited in the input end of the track 112 by the infeed conveyor 147, for reclosing the limit switch 162, so that when the pole 163*b* of the limit switch 163 recloses as the platen 90 reaches its full down position, the solenoid 224 is re-energized for restarting the container drive conveyor 120 in the manner described above, and starting another cycle of operation of the container loading system 20. The relay 218 remains energized through its latching contacts 218*a* and the now reclosed pole 161*a* of the limit switch 161.

If the selector switch 220 is switched to the hand-operated position, the upper pole thereof will be closed to maintain the relay 218 energized and the lower pole thereof will be open to de-energize the rest of the circuitry for testing and adjusting thereof.

Figure 13:
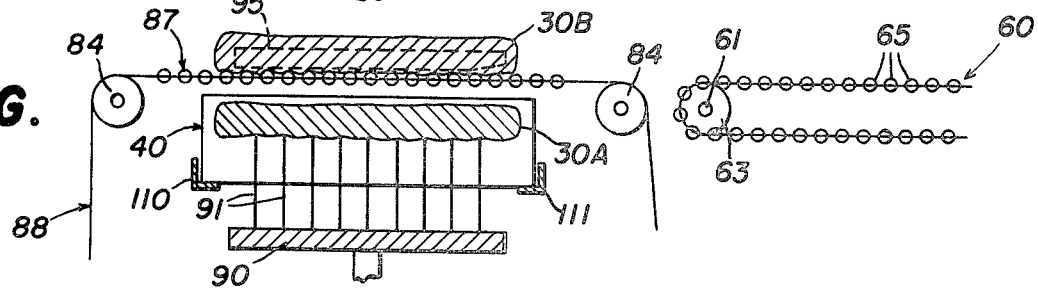
FIG. 13 is a diagrammatic view similar to FIG. 12, illustrating the positions of the parts when a first package has been deposited on the pins and lowered partway into the container and a second package of articles is in position to be deposited on top of the first package.

Referring to FIG. 13, it is a significant feature of the present invention that it may be operated to load either one or two layers of packages 30 in each container 40 at the loading station. In order to operate the system 20 to load two layers of packages 30 in each container 40, the selector switch 233 is switched to the position designated "2" in FIG. 15, thereby opening the upper pole thereof and closing the lower pole thereof. The operation of the system 20 in this mode is identical to that disclosed above for the single-layer mode of operation until the first package 30A has been lowered through the window 88 of the loader conveyor 80 onto the pins 91 and the continued movement of the loader conveyor 80 closes the limit switch 168. At this point only the solenoid 231 is energized to lower the platen 90 only partway to its intermediate receiving position, illustrated in FIG. 13. In this position, the upper surface of the package 30A on the pins 91 will be disposed substantially at the level at which the upper ends of the pins 91 were disposed when they were in their full up position. When the continued movement of the loader conveyor 80 closes the limit switch 169 to energize the relay 235, it stops the loader conveyor 80 in the manner described above, and also closes the contacts **235*a* of the relay 235 for energizing the relay 234, thereby closing its latching contacts 234*b* for latching it in an energized condition, and closing its contacts 234*a*. Closure of the contacts 234*a* does not energize the relay 232, however, because the limit switch 168 has reopened as the lug on the loader conveyor 80 moved past it to the limit switch 169**.

As the next package 30B being fed along the infeed conveyor 60 engages the lever actuator 158 to close the limit switch 160, the solenoid 240 is again energized for restarting the loader conveyor 80 in the manner described above, and the second package 30B proceeds to actuate the limit switch 161 for lowering the shoe 95 and shifting the package through a window section 88 of the loader conveyor 80 onto the top of the other package 30 already resting on the pins 91. When the lug on the loader conveyor 80 next closes the limit switch 168, both of the solenoids 231 and 232 are energized, since the relay contacts **234*a* are now closed, thereby lowering the platen 90 all the way to its full down position for lowering the two layers of packages 30A and B into the container 40. As the platen 90 lowers to its full down position, it closes the limit switch 167 to move the container stop assembly 140 back to its release position, and actuates the limit switch 163 to restart the container drive conveyor 120 and move the loaded container 40 from the loading station onto the outfeed conveyor 148 in the manner described above. When the drive lugs 130 on the container drive conveyor 120 actuate the limit switch 165, its pole 165*a* closes to again move the container stop assembly 140 back to its stop position and the pole 165*b* opens for de-energizing the relay 234** for the next cycle of operation.

In the modes of operation heretofore described, it has been assumed that each layer of product in a container 40 comprises a single package 30 which substantially covers the entire bottom area of the container 40. It is another important feature of this invention that it is also adapted selectively to operate in a mode of operation for loading what are known as "twin pack" packages into the containers 40. Each such "twin pack" is about one-half the size of a normal package 30, two such "twin packs" arranged in side-by-side or end-to-end relationship being required to cover the bottom of the container 40. In other words, each "twin pack" contains a subset of individual articles, two of which subsets are required to make a complete set of individual articles for comprising a complete layer of product in a container 40. The "twin packs" are fed individually from the associated packer to the infeed conveyor 60 in the same manner as are the fullsize packages 30. Therefore, the stop gate 149 has been provided to stop the movement of the first package of the "twin pack" until the second package catches up with it, whereupon the two are released and continue moving as a single package unit to the loader conveyor 80 for loading into a container 40.

Referring to FIG. 15 of the drawings, the control of the stop gate 149 in the "twin pack" mode of operation will be described. For this mode of operation, the selector switch 242 is closed by moving it to the "2" position, thereby energizing the photorelay 150 and producing a transverse light beam across the input end of the infeed conveyor 60. The photorelay 150 is energized or actuated when the light beam thereof is interrupted by the passage of the first package of a "twin pack" therethrough, thereby to close the contacts **150*a* and 150*c* and open the contacts 150*b* thereof, closure of the contacts 150*a* energizing the relay 245, thereby closing its latching contacts 245*a* to latch the relay 245 energized and also closing its contacts 245*b*. When the first package of the "twin pack" has passed through the light beam, the beam is reestablished for de-energizing the photorelay 150, thereby reopening the contacts 150*a* and reclosing the contacts 150*b* thereof. However, the relay 245 remains energized through its latching contacts 245*a*, wherefore the solenoid 246 and relay 247 are now energized through the closed relay contacts 150*b* and 245*b*. Energization of the solenoid 246 lowers the stop gate 149 to its stop position in the path of the first package of the "twin pack". Energization of the relay 247 closes its latching contacts 247*a* and its contacts 247*b*. When the first package of the "twin pack" arrives at the stop gate 149 and is stopped thereby, the free rollers 65 of the infeed conveyor 60** pass therebeneath.

When the second package of the "twin pack" breaks the light beam of the photorelay 150 and re-energizes it, the relay contacts **150*b* are opened, but the relay 247 and the solenoid 246 remain energized through the latching contacts 247*a*. Also, the photorelay contacts 150*c* are closed for energizing the relays 248 and 244 through the now closed relay contacts 247*b*, thereby closing the latching contacts 248*a*. Upon energization of the relay 244, its contacts 244*a* will open after a predetermined delay, sufficient to allow the second package of the "twin pack" to catch up with the stopped first package thereof. Upon opening of the contacts 244*a*, the relays 245 and 247 and solenoid 246 will all be de-energized, permitting the stop gate 149 to return to its pass position under the urging of suitable bias means (not shown), and permitting the now joined packages of the "twin pack" to proceed as a unit along the infeed conveyor 60 to the loader conveyor 80 for loading into a container 40 in the usual manner. When the second package of the "twin pack" has passed through the light beam, the photorelay 150 is de-energized for reopening the contacts 150***c* thereof, thereby de-energizing the relays 244 and 248 and returning the "twin pack" control circuit to its initial condition in preparation for the arrival of the first package of the next "twin pack".

It will be appreciated that the stop gate 149 should be so positioned and the delay on the relay contacts 244*a* should be such that the second package of the "twin pack" will catch up with the first package thereof before the second package exits the light beam of the photorelay 150. Otherwise, when the second package of the "twin pack" exits the light beam, the energization of the photorelay 150 will open its contacts 150*c* for de-energizing the relay 244 before the expiration of the delay on the contacts 244*a*, thereby preventing retraction of the stop gate 149 to its pass position.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. In a loader for loading into containers at a loading station sets of grouped individual articles, container handling apparatus comprising container transfer means for moving an empty container along a container path to the loading station whole simultaneously removing a filled container from the loading station along said path and thereafter supporting the empty container at the loading station, stop means movable between a stop position in the path of a container accurately to position it at the loading station and a release position out of the path of the container to accommodate removal thereof from the loading station, conveying means for transporting a set of grouped individual articles along an article path to the loading station and into a container thereat, and control means coupled to said container transfer means and to said stop means and responsive to operation of said container transfer means in moving a container to the loading station for moving said stop means to the stop position thereof and for subsequently stopping said container transfer means, said control means being responsive to completion of the loading of a container for moving said stop means to the release position thereof and restarting said container transfer means to move a new empty container to the loading station and to remove the filled container from the loading station.

2. The container handling apparatus set forth in claim 1, wherein said control means includes pneumatic means for operating said stop means, and electrical circuit means including a plurality of switch means for actuating said container transfer means and said pneumatic means and said conveying means.

3. The container handling apparatus set forth in claim 1, wherein said container path and said article path are disposed substantially at right angles to each other.

4. The container handling apparatus set forth in claim 1, wherein said container path defines a straight line.

5. The container handling apparatus set forth in claim 1, wherein said container transfer means includes track means defining said container path and accommodating a plurality of containers thereon.

6. In a loader for loading into containers at a loading station sets of grouped individual articles, container handling apparatus comprising track means defining a container path through the loading station for supporting a series of containers thereon and accommodating movement of the containers therealong, drive means adjacent to said track means and engageable with the rearmost one of the series of containers for moving it and the rest of the series in a direction toward the loading station while pushing a filled container from the loading station, stop means movable between a stop position in the path of the forwardmost one of the series of empty containers accurately to position it in the loading station and a release position out of the path of the container to accommodate removal thereof from the loading station when filled, conveying means for transporting a set of grouped individual articles along an article path to the loading station and into a container thereat, and control means coupled to said drive means and to said stop means and responsive to operation of said drive means in moving the series of containers toward the loading station for moving said stop means to the stop position thereof and for subsequently stopping said drive means, said control means being responsive to completion of the loading of the container at the loading station for moving said stop means to the release position thereof and restarting said drive means to move the filled container from the loading station and move a new empty container to the loading station.

7. The container handling apparatus set forth in claim 6, wherein said drive means includes an endless conveyor chain and a drive member carried by said chain for driving engagement with the rearmost one of the series of containers.

8. The container handling apparatus set forth in claim 6, wherein said drive means includes an endless conveyor chain and a drive member mounted on said chain for pivotal movement about an axis disposed transverse to the direction of movement of the chain between a driving position and a pass position, and guide means engageable with said drive member along a portion of the path of said endless chain for holding said drive member in the driving position thereof disposed for driving engagement with the rearmost one of the series of containers, said drive member when it moves out of engagement with said guide means being urged by gravity to the release position thereof out of driving engagement with the series of containers to pass thereby and discontinue driving thereof.

9. The container handling apparatus set forth in claim 6, wherein said drive means includes a pair of endless conveyor chains spaced apart laterally of said track, and two drive members respectively carried by said chains in lateral alignment with each other for driving engagement with the rearmost one of the series of containers.

10. A loader for depositing into containers each having a plurality of openings in the bottom thereof sets of grouped individual articles, said loader comprising container transfer means for moving an empty container along a container path to the loading station while simultaneously removing a filled container from the loading station along said path and thereafter supporting the empty container at the loading station, stop means movable between a stop position in the path of a container accurately to position it at the loading station and a release position out of the path of the container to accommodate removal thereof from the loading station, article lowering means including a plurality of supports respectively reciprocable through the openings in the bottom of the associated container at said loading station between a receiving position above the container and a depositing position below the container and withdrawn from the openings therein, conveying means for transporting a set of grouped individual articles along an article path onto said supports in the receiving position thereof, and control means coupled to said container transfer means and said stop means and said article lowering means and said conveying means for controlling the operations thereof, said control means including means responsive to operation of said container transfer means in moving a container to the loading station for causing said control means to move said stop means to the stop position thereof and to stop said container transfer means and to actuate said article lowering means for movement of said supports to the receiving position thereof, said control means including means responsive to operation of said conveying means in transporting a set of grouped individual articles onto said supports for causing said control means sequentially to actuate said lowering means for moving said supports to the depositing position thereof and to move said stop means to the release position thereof and to restart said container transfer means for moving a new empty container to the loading station and for removing the filled container from the loading station.

11. The loader set forth in claim 10, wherein said control means comprises electrical circuit means including a plurality of switches responsive to the positions of the containers and said conveying means and said article lowering means.

12. The loader set forth in claim 10, wherein said container path and said article path and the path of said article lowering means are disposed substantially perpendicular to one another.

13. A loader for depositing into containers each having a plurality of openings in the bottom thereof sets of grouped individual articles, said loader comprising container transfer means for moving an empty container along a container path to the loading station while simultaneously removing a filled container from the loading station along said path and thereafter supporting the empty container at the loading station, stop means movable between a stop position in the path of a container accurately to position it at the loading station and a release position out of the path of the container to accommodate removal thereof from the loading station, article lowering means including a plurality of supports respectively reciprocable through the openings in the bottom of the associated container at said loading station between a receiving position above the container and a depositing position below the container and withdrawn from the openings therein, first conveying means for transporting sets of grouped individual articles to a shifting location disposed above said loading station and in general registration therewith, second conveying means for moving sets of grouped individual articles from an associated supply to said first conveying means, shifting means for shifting an associated set of grouped individual articles at said shifting location from said first conveying means onto said supports in the receiving position thereof, and control means coupled to said container transfer means and said stop means and said article lowering means and said first conveying means and said shifting means for controlling the operations thereof, said control means including means responsive to operation of said container transfer means in moving a container to the loading station for causing said control means to move said stop means to the stop position thereof and stop said container transfer means and to actuate said article lowering means for movement of said supports to the receiving position thereof, said control means including means responsive to operation of said second conveying means in transporting a set of grouped individual articles to said first conveying means for causing said control means to actuate said first conveying means, said control means including means responsive to operation of said first conveying means in transporting a set of grouped individual articles to said shifting location for causing said control means sequentially to actuate said shifting means for shifting the set of grouped individual articles onto said supports and to actuate said lowering means for moving said supports to the depositing position thereof and to stop said first conveying means, said control means including means responsive to lowering of said supports to the depositing position thereof for causing said control means to move said stop means to the release position thereof and to restart said container transfer means for moving a new empty container to the loading station and for removing the filled container from the loading station.

14. The loader set forth in claim 13, wherein said control means includes a first sensing member disposed in the path of articles moving along said first conveying means and a second sensing member disposed in the path of articles moving along said second conveying means, said second sensing member being responsive to engagement by articles on said second conveying means for actuating said first conveying means, said first sensing member being responsive to engagement by articles on said first conveying means for actuating said shifting means.

15. The loader set forth in claim 13, wherein said control means includes first switch means responsive to movement of said first conveying means to a first position for actuating said article lowering means, and second switch means responsive to movement of said first conveying means to a second position for stopping said first conveying means.

16. The loader set forth in claim 13, wherein said first conveying means comprises a roller conveyor including two sections of free rollers spaced apart by two window sections, said shifting means including a shoe engageable with the rollers of said roller sections for causing an associated set of grouped individual items thereon to be fed into and through the adjacent trailing window section and onto said article lowering means.

17. A loader for depositing into containers each having a plurality of openings in the bottom thereof sets of grouped individual articles, said loader comprising container transfer means for moving an empty container along a container path to the loading station while simultaneously removing a filled container from the loading station along said path and thereafter supporting the empty container at the loading station, stop means movable between a stop position in the path of a container accurately to position it at the loading station and a release position out of the path of the container to accommodate removal thereof from the loading station, article lowering means including a plurality of supports respectively reciprocable through the openings in the bottom of the associated container at said loading station between an upper receiving position above the container and a depositing position below the container and withdrawn from the openings therein and an intermediate receiving position spaced below the upper receiving position a distance substantially equal to the thickness of a set of grouped individual articles, conveying means for transporting a set of grouped individual articles onto said supports in the upper receiving position thereof and onto an associated set of grouped individual articles positioned on said supports in the intermediate receiving position thereof, and control means coupled to said container transfer means and said stop means and said article lowering means and said conveying means for controlling the operations thereof, said control means including means responsive to operation of said container transfer means in moving a container to the loading station for causing said control means to move said stop means to the stop position thereof and to stop said container transfer means and to actuate said article lowering means for movement of said supports to the upper receiving position thereof, said control means including means responsive to operation of said conveying means in transporting a first set of grouped individual articles onto said supports for causing said control means to actuate said lowering means for moving said supports to the intermediate receiving position thereof, said control means including means responsive to operation of said conveying means in transporting a second set of grouped individual articles onto said supports for causing said control means sequentially to actuate said lowering means for moving said supports to the depositing position thereof and to move said stop means to the release position thereof and to restart said container transfer means for moving a new empty container to a loading station and for removing the filled container from the loading station.

18. The loader set forth in claim 17, wherein said control means includes selector means for selectively placing said control means in a single-layer mode and a double-layer mode, said control means in the single-layer mode thereof being responsive to operation of said conveying means in transporting a first set of grouped individual articles onto said supports for causing said control means to actuate said lowering means for moving said supports directly to the depositing position thereof.

19. A loader for depositing into containers each having a plurality of openings in the bottom thereof sets of grouped individual articles, said loader comprising container transfer means for moving an empty container along a container path to the loading station while simultaneously removing a filled container from the loading station along said path and thereafter supporting the empty container at the loading station, stop means movable between a stop position in the path of a container accurately to position it at the loading station and a release position out of the path of the container to accommodate removal thereof from the loading station, article lowering means including a plurality of supports respectively reciprocable through the openings in the bottom of the associated container at said loading station between an upper receiving position above the container and a depositing position below the container and withdrawn from the openings therein and an intermediate receiving position spaced below the upper receiving position a distance substantially equal to the thickness of a set of grouped individual articles, first conveying means for transporting a set of grouped individual articles to a shifting location disposed above said loading station and in general registration therewith, second conveying means for moving sets of grouped individual articles from an associated supply to said first conveying means, shifting means for shifting an associated set of grouped individual articles at said shifting location from said first conveying means onto said supports in the receiving position thereof, and control means coupled to said container transfer means and said stop means and said article lowering means and said first conveying means and said shifting means for controlling the operations thereof, said control means including means responsive to operation of said container transfer means in moving a container to the loading station for causing said control means to move said stop means to the stop position thereof and stop said container transfer means and to actuate said article lowering means for movement of said supports to the receiving position thereof, said control means including means responsive to operation of said second conveying means in transporting a set of grouped individual articles to said first conveying means for causing said control means to actuate said first conveying means, said control means including means responsive to operation of said first conveying means in transporting the first set of grouped individual articles to said shifting location for causing said control means sequentially to actuate said shifting means for shifting the first set of grouped individual articles onto said supports and to actuate said lowering means for moving said supports to the intermediate receiving position thereof and to stop said first conveying means, said control means including means responsive to operation of said second conveying means in transporting a second set of grouped individual articles to said first conveying means for causing said control means to reactuate said first conveying means, said control means including means responsive to operation of said first conveying means in transporting the second set of grouped individual articles to said shifting location for causing said control means sequentially to actuate said shifting means for shifting the second set of grouped individual articles onto the first set of grouped individual articles on said supports and to actuate said lowering means for moving said supports to the depositing position thereof and to stop said first conveying means, said control means including means responsive to lowering of said supports to the depositing position thereof for causing said control means to move said stop means to the release position thereof and to restart said container transfer means for moving a new empty container to the loading station and for removing the filled container from the loading station.

20. A loader for depositing into containers at a loading station sets of grouped individual articles wherein each set comprises two subsets of grouped individual articles, said loader comprising container transfer means for moving an empty container along a container path to the loading station while simultaneously removing a filled container from the loading station along said path and thereafter supporting the empty container at the loading station, first stop means movable between a stop position in the path of a container accurately to position it in the loading station and a release position out of the path of the container to accommodate removal thereof from the loading station, conveying means for transporting a set of grouped individual articles along an article path to the loading station and into a container thereat, second stop means disposed adjacent to the article path and movable between a pass position out of the article path and a stop position disposed in the article path for blocking the movement of articles therealong, first control means responsive to movement of a first subset of grouped individual articles past a predetermined point along the article path for moving said second stop means to the stop position thereof to engage the first subset of articles and stop the movement thereof along the article path, said first control means being responsive to movement of a second subset of grouped individual articles to said predetermined point for moving said second stop means to the release position thereof after the second subset has moved into engagement with the first subset to form a set of grouped individual articles, and second control means coupled to said container transfer means and said first stop means for controlling the operations thereof, said second control means including means responsive to operation of said container transfer means in moving a container to the loading station for causing said second control means to move said first stop means to the stop position thereof and to stop said container transfer means and to actuate said article lowering means for movement of said supports to the receiving position thereof, said second control means including means responsive to operation of said conveying means in transporting a set of grouped individual articles into a container for causing said second control means to move said first stop means to the release position thereof and to restart said container transfer means for moving a new empty container to the loading station and for removing the filled container from the loading station.

21. The loader set forth in claim 20, wherein said first control means includes a photorelay disposed at said predetermined point and creating a light beam in the path of the articles.

22. The loader set forth in claim 20, wherein said conveying means includes first conveying means for transporting a set of grouped individual articles to a shifting location disposed above said loading station and in general registration therewith, and second conveying means for moving sets of grouped individual articles from an associated supply to said first conveying means, said predetermined point being disposed along said second conveying means.

23. The loader set forth in claim 20, and further including selector means for selectively enabling and disabling said first control means and said second stop means.

* * * * *